United States Patent [19]

Fletcher et al.

[11] 4,399,025

[45] Aug. 16, 1983

[54] SOLVENT EXTRACTION PROCESS FOR REREFINING USED LUBRICATING OIL

[75] Inventors: Laird C. Fletcher; Richard H. O'Blasny, both of Natchitoches, La.

[73] Assignee: Delta Central Refining, Inc., Natchitoches, La.

[21] Appl. No.: 309,576

[22] Filed: Oct. 8, 1981

Related U.S. Application Data

[63] Continuation-in-part of Ser. No. 202,015, Oct. 28, 1980, Pat. No. 4,302,325.

[51] Int. Cl.[3] ..... C10G 21/16

[52] U.S. Cl. ..... 208/180; 208/327

[58] Field of Search ..... 208/180, 327

[56] References Cited

U.S. PATENT DOCUMENTS

| | | |
|---|---|---|
| 1,584,588 | 5/1926 | Acheson . |
| 2,583,620 | 1/1952 | Wrightson . |
| 3,024,171 | 3/1962 | Bone . |
| 3,173,859 | 3/1965 | Chambers . |
| 3,305,478 | 2/1967 | Gilson et al. . |
| 3,450,627 | 6/1969 | Johnson et al. . |
| 3,607,731 | 9/1971 | Gulick . |
| 3,620,967 | 11/1971 | Gulick . |
| 3,625,881 | 12/1971 | Chambers et al. . |
| 3,763,036 | 10/1973 | Jordan et al. . |
| 3,773,658 | 10/1973 | Vu et al. . |
| 3,791,965 | 2/1974 | Fitzsimons et al. . |
| 3,864,242 | 2/1975 | Watanabe . |
| 3,870,625 | 3/1975 | Wielezynski . |
| 3,879,282 | 4/1975 | Johnson . |
| 3,919,076 | 11/1975 | Cutler et al. . |
| 3,923,643 | 12/1975 | Lewis et al. . |
| 3,929,626 | 12/1975 | Button et al. . |
| 3,954,602 | 5/1976 | Troesch et al. . |
| 3,980,551 | 9/1976 | Wolk . |
| 3,985,642 | 10/1976 | Friel et al. . |
| 4,021,333 | 5/1977 | Habiby et al. . |
| 4,029,569 | 6/1977 | Ivey, Jr. . |
| 4,033,859 | 7/1977 | Davidson et al. . |
| 4,038,176 | 7/1977 | Noren et al. . |
| 4,045,330 | 8/1977 | Avrillon et al. . |
| 4,071,438 | 1/1978 | O'Blasny . |
| 4,073,719 | 2/1978 | Whisman et al. . |
| 4,073,720 | 2/1978 | Whisman et al. . |
| 4,097,369 | 6/1978 | Ebel et al. . |
| 4,101,414 | 7/1978 | Kim et al. . |
| 4,105,538 | 8/1978 | Mattox . |
| 4,140,212 | 2/1979 | O'Blasny et al. . |

FOREIGN PATENT DOCUMENTS

| | | |
|---|---|---|
| 49-69702 | 7/1974 | Japan . |

OTHER PUBLICATIONS

"Waste Lubricating Oil Research", Published in Bureau of Mines Report of Investigations/1974–RI 7884.

"Waste Lubricating Oil Research", Published in Bureau of Mines Report of Investigations/1974–RI 7925.

*Primary Examiner*—Delbert E. Gantz
*Assistant Examiner*—O. Chaudhuri
*Attorney, Agent, or Firm*—Winburn & Gray, Ltd.

[57] ABSTRACT

In accordance with the present invention, a process is provided for removing impurities from heavy and light lube oil fractions that have been obtained from waste lubricating oil. The impurities in the light lube oil fraction are removed utilizing tetrahydrofurfuryl alcohol in an extraction column (10). An oil-rich raffinate has the solvent removed therefrom by steam distillation and stripping at reduced pressure in a distillation tower (20). The heavy lube oil fraction is purified in a manner similar to the purification of the light lube oil fraction. Alternatively, most of the tetrahydrofurfuryl alcohol can be removed from the oil-rich raffinate by mixing the raffinate with methanol in an extraction column. The last of the tetrahydrofurfuyl alcohol is then removed from the oil by steam distillation and stripping at a reduced pressure. The finished heavy and light lube oil may then be subjected to further treatment, such as polishing steps, or additives may be blended into the lube oil product depending on the desired use.

13 Claims, 3 Drawing Figures

SOLVENT EXTRACTION PROCESS FOR REREFINING USED LUBRICATING OIL

REFERENCE TO OTHER APPLICATION

This application is a continuation-in-part of Ser. No. 202,015, filed Oct. 28, 1980 and entitled "Solvent Extraction Process for Rerefining Used Lubricating Oil now U.S. Pat. No. 4,302,325."

TECHNICAL FIELD

This invention relates to rerefining used lubricating oil. More particularly, this invention relates to a solvent extraction process for rerefining used lubricating oil that has been fractionated into heavy and light lube fractions.

BACKGROUND ART

This invention relates to a process for the reclamation and rerefining of waste hydrocarbon lubricating oils. In particular, the invention provides an extraction process for removing impurities from waste oil that has been fractionated into light and heavy lube fractions.

Large and increasing volumes of used lubricating oil, particularly crank case oils from diesel and internal combustion engines, are produced each year. These waste oils are contaminated with oxidation and degradation products, water, fine particulates, metal and carbon oil additive products. These contamination components render the oils unsuitable for continued use. Waste oils have generally been disposed of by incineration, in land fill, or used in road oiling for dust control because the cost of reclamation and rerefining has been excessive. However, because of the rising cost of hydrocarbon fuels and lubricants, coupled with the ever increasing demand and depletion of these resources, the need for an efficient, low-cost waste oil rerefining process has arisen.

In recent years some small scale rerefining processes have been put into operation in which marketable oils are recovered. However, due to the high cost involved and the resulting narrow margin of profit, such recovery processes represent a small percentage utilization of the total quantity of used lubricating oils.

The ever-increasing scarcity and consequent rising costs of petroleum, particularly high quality lubricating stocks, now present positive incentives to selectively remove undesirable contaminants from used motor oils and reuse the valuable high quality lubricating components contained in such oils.

Several waste oil rerefining processes are known from the prior art. For example, in U.S. Pat. No. 3,639,229, a process is described where a mixture of an aliphatic monohydric alcohol of from 4 to 5 carbon atoms and a light hydrocarbon is added to waste oil. The mixture settles into three distinct layers. The upper oily layer is recovered, treated with sulfuric acid and thereafter refined by conventional means. In U.S. Pat. No. 3,919,076, a process is described that involves removing water from the waste oil, adding the saturated hydrocarbons solvent, settling the mixture to recover the oil/solvent mix, removing the solvent, vacuum distilling the residual oil to collect selected fractions, hydrogenating the fractions in the presence of a catalyst, stripping hydrogenated oil to remove light ends and filtering the remaining products. U.S. Pat. No. 4,124,492 discloses a process for reclaiming useful hydrocarbon oil from contaminated waste oil in which the waste oil is dehydrated and, thereafter, the dehydrated oil is dissolved in selected amounts of isopropanol. The undissolved waste matter is separated and the residual oil/solvent fraction is distilled to recover the decontaminated oil and solvent. The recovered oil is further clarified by treatment with a bleaching clay or activated carbon at elevated temperatures.

Thus, a need has arisen for an effective method of purifying waste oil that has been fractionated into heavy and light tube fractions, such as disclosed in U.S. patent application Ser. No. 202,019, now U.S. Pat. No. 4,342,645.

DISCLOSURE OF THE INVENTION

The process in accordance with the present invention is preferably utilized with a process that produces heavy and light lube oil fractions from waste lubricating oil, such as the process described in U.S. patent application Ser. No. 202,019, filed Oct. 28, 1980.

In accordance with the present invention, a process is provided for rerefining and purifying used oil containing lubricating oil where the used oil has been fractionated into a light lube oil and a heavy lube oil. The process includes mixing the heavy lube oil with an effective amount of tetrahydrofurfuryl alcohol for extracting impurities from heavy oil. Thereafter, the heavy oil is separated from the tetrahydrofurfuryl alcohol containing impurities removed from the oil. The light lube oil fraction is also mixed with an effective amount of tetrahydrofurfuryl alcohol for removing impurities from the light lube oil. After mixing, the light lube oil is separated from the tetrahydrofurfuryl alcohol containing impurities removed from the oil.

According to one embodiment of the present invention, the heavy lube oil and tetrahydrofurfuryl alcohol mixture is separated to form a heavy oil raffinate and a tetrahydrofurfuryl alcohol extract. The light lube oil and tetrahydrofurfuryl alcohol mixture is similarly separated into a light lube oil raffinate and a tetrahydrofurfuryl alcohol extract. Thereafter, the tetrahydrofurfuryl alcohol is removed from the heavy lube oil raffinate by distilling and steam stripping. Similarly, the tetrahydrofurfuryl alcohol is removed from the light lube oil raffinate by distilling and steam stripping.

The extracts from the extraction units for each of the heavy and light lube fractions are combined and the tetrahydrofurfuryl alcohol solvent is distilled and stripped from the mixture. The solvent is then condensed for reuse in extracting impurities from the light and heavy lube fractions. Alternatively, the extracts from the extraction units for the heavy and light lube fractions are distilled separately.

According to another embodiment of the present invention, the heavy lube oil and tetrahydrofurfuryl alcohol mixture is separated to form a heavy oil raffinate and a tetrahydrofurfuryl alcohol extract. The light lube oil and tetrahydrofurfuryl alcohol mixture is similarly separated into a light lube oil raffinate and a tetrahydrofurfuryl alcohol extract. The heavy lube oil raffinate is then mixed with an effective amount of methanol to remove most of the residual tetrahydrofurfuryl alcohol remaining in the heavy lube oil raffinate. The methanol is then separated from the heavy lube oil raffinate. Thereafter, any remaining tetrahydrofurfuryl alcohol is removed from the heavy lube oil raffinate by distilling and steam stripping. Similarly, the light lube oil raffinate is mixed with an effective amount of methanol to remove most of the residual tetrahydrofurfuryl alcohol remaining in the light lube oil raffinate. The methanol is then separated from the light lube oil raffinate. The remaining tetrahydrofurfuryl alcohol is then removed from the light lube oil raffinate by distilling and steam stripping.

The tetrahydrofurfuryl alcohol extracts from the light and heavy lube fractions are combined and mixed with the methanol extracts from the light and heavy lube fractions. Alternatively, the tetrahydrofurfuryl alcohol extracts from the light and heavy lube fractions are not combined prior to mixing with methanol extracts. Most of the quality oil remaining in the extracts is separated and comingled with the light lube oil raffinate prior to the distilling and steam stripping of the tetrahydrofurfuryl alcohol from the light lube oil raffinate. Methanol is then separated from the remaining tetrahydrofurfuryl alcohol and methanol extracts by distilling and steam stripping. Thereafter, the tetrahydrofurfuryl alcohol is separated from the tetrahydrofurfuryl extract.

Use of tetrahydrofurfuryl alcohol in accordance with the present invention provides a greater selectivity and higher yields of raffinate and has a greater affinity for contaminants found in used lubricating oil.

Methanol is used as a second-stage antisolvent to remove the residual tetrahydrofurfuryl alcohol remaining in the raffinate, thereby improving the quality of the lubricating oil. Alternatively, compounds such as ethanol and acetone can be used as a second-stage wash antisolvent.

DESCRIPTION OF DRAWINGS

The invention can be more completely understood by reference to the accompanying drawings, in which.

DETAILED DESCRIPTION

According to the present invention, a method is provided for removing impurities from waste lubricating oils that have been fractionated into light and heavy lube fractions. For example, a suitable process for fractionating waste lubricating oil into heavy and light lube fractions is described in U.S. patent application Ser. No. 202,105, having the title "Solvent Extraction Process for Rerefining Used Lubricating Oil" with Messrs. Laird C. Fletcher and Harold J. Beard being the inventors.

Figure 1:
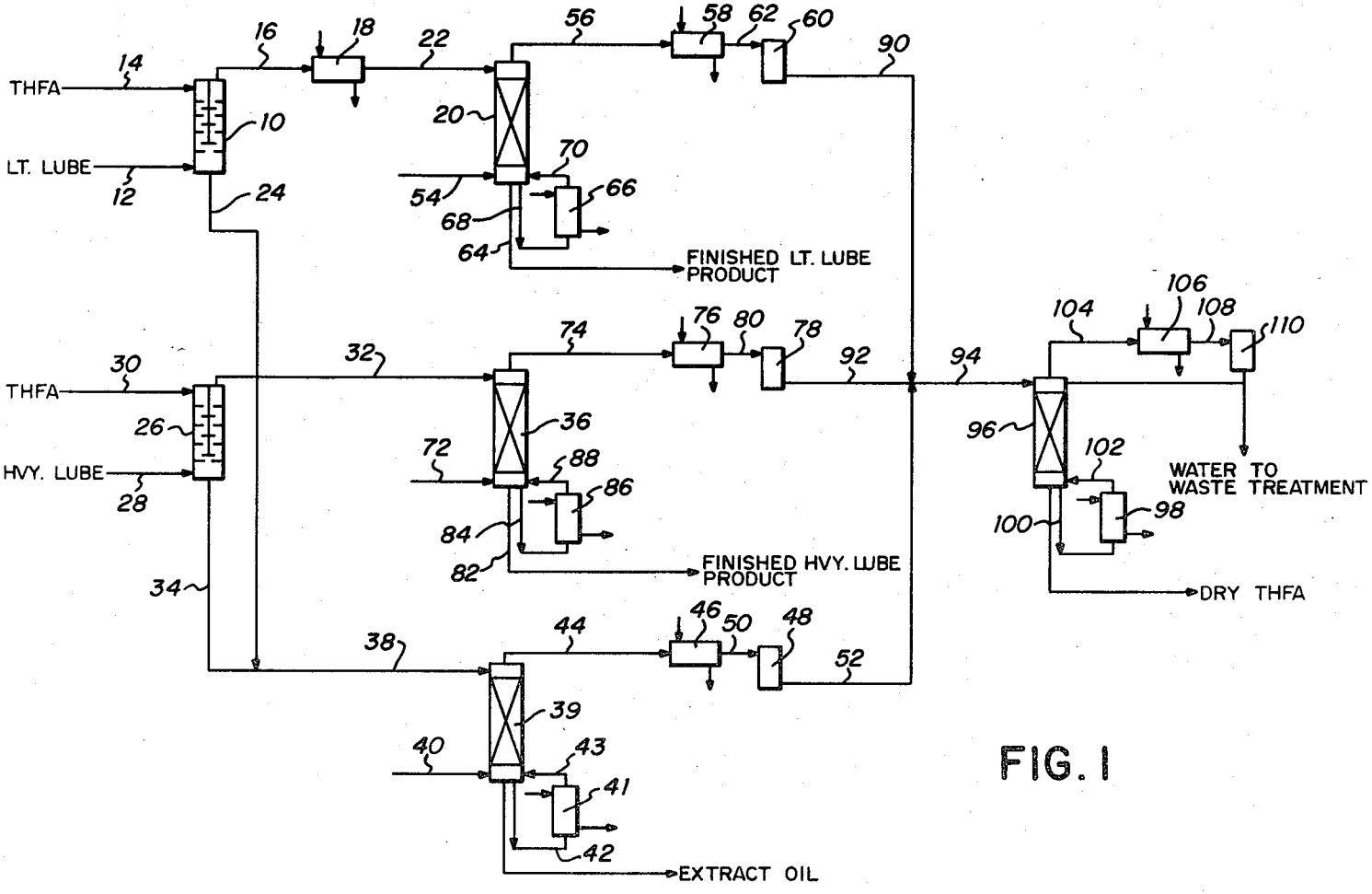
FIG. 1 is a schematic flow sheet of one embodiment of the present invention.

Referring to FIG. 1, the light lube fraction enters an extraction column 10 via a line 12. Extraction device 10 is, for example, a rotary disc contactor or any other suitable device for bringing the two phases into intimate contact. Tetrahydrofurfuryl alcohol enters extraction device 10 via a line 14. Tetrahydrofurfuryl alcohol, hereinafter referred to as "THFA," is also known as tetrahydrofuryl carbinol and has the following molecular formula: $C_4H_7OCH_2OH$. THFA is a colorless liquid having a mild odor that is miscible with water and has a specific gravity of about 1.054 at 20° C. THFA is hygroscopic and is generally believed to have low toxicity. For example, see the *Condensed Chemical Dictionary,* 9th Edition, published by Van Nostrand Reinhold.

The light lube fraction and/or THFA may be heated, prior to mixing, in the range of, for example 125°–250° F.

Preferably, the light lube oil fraction and THFA entering extraction device 10 are at a temperature of approximately 150° F. Upon entering extraction device 10, the light lube fraction and THFA are thoroughly mixed. In a preferred embodiment of the present invention, the volume ratio of light lube oil to THFA is about 1:1. This parameter is not a limitation upon the present invention.

An oil-rich top layer or raffinate exits through a raffinate line 16 from extraction device 10. The raffinate generally contains about 95% oil and about 5% THFA by weight. The raffinate exits line 16 and enters a heat exchanger 18 for heating the raffinate to a temperature of approximately 200° F. After heating in heat exchanger 18, the raffinate is directed to a distillation column 20 via a line 22. The extract exits another line, as hereinafter described, for distillation and steam stripping.

As shown in FIG. 1, the heavy lube fraction is treated in a manner similar to the treatment for the light lube fraction previously described. The heavy lube fraction and/or THFA may be heated, prior to mixing, in the range of, for example 125°–250° F. The heavy lube oil fraction enters an extraction device 26 via a line 28. The THFA enters extraction device 26 via a line 30. Preferably, the heavy lube oil fraction and THFA entering extraction device 26 are at a temperature of approximately 150° F. The THFA and heavy lube oil are then mixed in extraction device 26 from which exit a raffinate line 32 and an extract line 34. Raffinate line 32 generally contains about 95% oil and 5% THFA by weight. Extract line 34 generally contains by weight about 95% THFA and 5% oil plus the impurities that were removed in the extraction process. Raffinate line 32 is then directed to a heavy oil raffinate distillation and steam stripping column 36, which is hereinafter described.

The extract lines 24 and 34 are combined into a single extract line 38 which is directed to a distillation and steam stripping tower 39. Distillation and steam stripping tower 39 is utilized to distill and steam strip the THFA from the extract. A steam line 40 delivers steam to distillation and steam stripping column 39. The THFA solvent is distilled from the extract and is stripped, exiting through a distillate line 44. Distillation and steam stripping column 39 is preferably operated at a pressure of about 50 millimeters mercury absolute and a temperature at about 200° F. A steam reboiler 41 may be utilized to provide additional heat for distillation and steam stripping tower 39 with a line 42 exiting distillation and steam stripping column 39 and entering reboiler 41 which discharges into distillation and steam stripping column 39 via line 43. After the solvent is distilled, it is condensed by a condenser 46, thereafter entering a storage tank 48 via a line 50. The THFA solvent is removed from storage tank 48 via a line 52 for further treatment as hereinafter described.

As shown in FIG. 1, the light oil raffinate is distilled and steam stripped in distillation column 20. The light and/or heavy raffinates can be distilled and steam stripped at a pressure of from, for example, about 10 to 100 mg Hg absolute. Distillation column 20 is preferably operated at a temperature of about 200° F. and an absolute pressure of about 50 millimeters mercury. Steam is injected through a steam line 54 into distillation column 20. The solvent is distilled and stripped exiting into a distillate line 56. Thereafter, the distillate THFA is condensed in a condenser 58. The condensed THFA thereafter enters a storage vessel 60 via a line 62 where the THFA is stored for further treatment which is hereinafter described.

The residue or finished light lubricating oil exits distillation column 20 through a residue line 64, where it is transferred to storage or to further treatment. Final treatment before actual use as a lubricant may include polishing steps and the addition of specific additives. A steam reboiler 66 may be utilized to provide additional heat for distillation column 20 with a line 68 exiting distillation tower 20 and entering reboiler 66 which discharges into distillation column 20 via a line 70.

The distillation and steam stripping of the heavy lube oil raffinate are similar to the distillation and steam stripping of the light oil raffinate previously described. The heavy oil raffinate enters distillation and steam stripping column 36 via line 32. Steam is injected into stripping column 36 via line 72. The solvent is distilled and stripped, exiting column 36 via a distillate line 74. The THFA distillate is condensed in a condenser 76 where it is thereafter transferred to a storage vessel 78 via a line 80. The THFA is stored for further treatment which is hereinafter described. The residue or finished heavy oil exits stripping column 36 through a residue line 82. Thereafter the finished heavy lube oil may be subjected to further treatment, such as polishing steps, or additives may be blended into the heavy lube product depending on the desired use.

Distillation and steam stripping column 36 may also include a reboiler for introducing additional energy into the distillation and steam stripping process. A line 84 exits stripping column 36 and enters steam heated reboiler 86 which discharges into a steam stripping column 36 via a line 88.

In accordance with a preferred embodiment, the final step of the process includes distillation of the recovered THFA to remove water from the THFA to prepare it for reuse. The recovered THFA from holding vessels 48, 60 and 78 is combined via lines 52, 90 and 92, respectively to form a line 94. Line 94 enters a distillation column 96. Distillation column 96 is equipped with a reboiler 98 that recirculates a portion of the column bottoms liquid by use of a line 100 that exits distillation column 96 and enters reboiler 98. Reboiler 98 discharges into line 102 which enters distillation column 96. The distillate of distillation column 96 is primarily water and enters a line 104. Line 104 enters a condenser 106 for condensing the water distillate. The condensate from condenser 106 enters line 108 and is stored in a storage tank 110. A portion of the water in storage tank 110 is recycled into the top of distillation column 96 as reflux. The remainder of the water in storage tank 110 is sent to a waste treatment facility. Dry THFA exits from the bottom of column 96 and is sent to storage or reused at the beginning of the process, for example, in lines 14 and 30.

Figure 2:
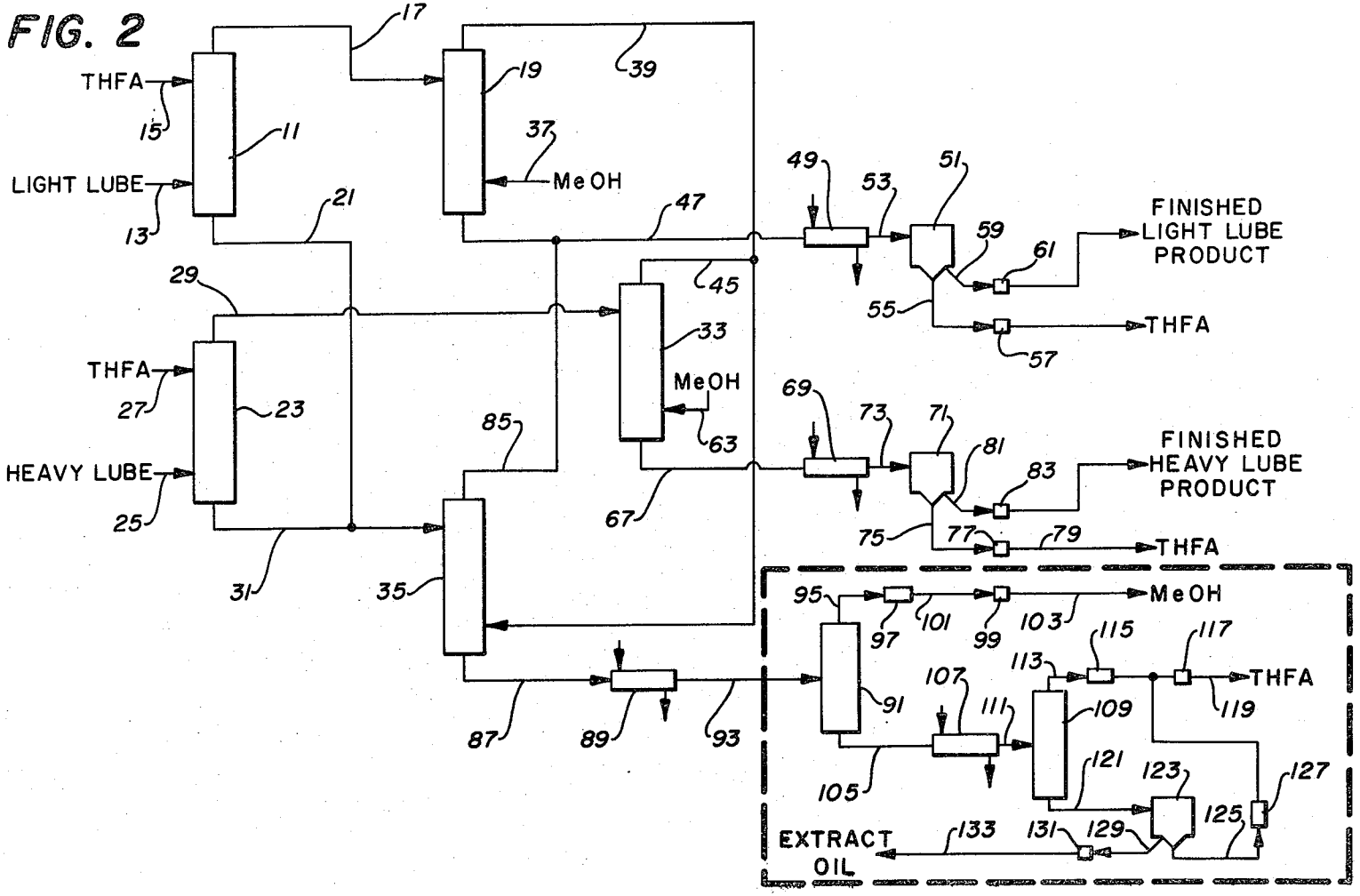
FIG. 2 is a schematic flow sheet of another embodiment of the present invention.

In accordance with another embodiment of the present invention, a second-stage wash antisolvent is utilized to remove most of the THFA from the light and heavy oil raffinates prior to distilling and steam stripping. FIG. 2 is a schematic flow sheet of this alternate embodiment of the present invention.

Referring to FIG. 2, the light lube fraction enters an extraction column 11 via a line 13. The extraction device 11 is, for example, a rotary disc contactor or any suitable device for bringing the two phases into intimate contact. THFA enters the extraction device 11 via a line 15.

Preferably, the light lube oil fraction and THFA entering the extraction device 11 are at a temperature of approximately 140° F. Upon entering the extraction device 11, the light lube fraction and THFA are thoroughly mixed. In a preferred embodiment of the present invention, the volume ratio of light lube oil to THFA is about 1:1. This parameter is not a limitation upon the present invention. Further, it is preferred that the light lube fraction pass through a filter before entering the extraction device 11.

An oil-rich top layer or raffinate exits through a raffinate line 17 from the extraction device 11. The light raffinate generally contains about 95% oil and about 5% THFA by weight. The light raffinate is then directed to an extraction device 19. The THFA-rich bottom layer or THFA extract exits the extraction device 11 via a line 21 and is then directed to comingle with a THFA extract line from the heavy lube fraction extraction device as hereinafter described.

As shown in FIG. 2, the heavy lube fraction is treated in a manner similar to the treatment for the light lube fraction previously described. The heavy lube oil fraction enters an extraction device 23 via a line 25. THFA then enters the extraction device 23 via a line 27. Preferably, the heavy lube oil fraction and THFA entering the extraction device 23 are at a temperature of approximately 140° F. and are present in a volume ratio of 1:1. Further, the heavy lube fraction is preferably passed through a filter prior to entering the extraction device 23. The THFA and heavy lube oil are then mixed in the extraction device 23. The heavy oil raffinate exits the extraction device 23 through a raffinate line 29 and the THFA extract exits via a THFA extract line 31. The raffinate line 29 generally contains about 95% oil and 5% THFA by weight. The extract line 31 generally contains about 95% THFA and 5% oil by weight plus the impurities that were removed in the extraction process. The heavy raffinate line 29 is then directed to an extraction device 33 for further treatment as hereinafter described. The THFA extract is directed to comingle with the THFA extract line 21 from the light lube fraction as previously described. The light and heavy THFA extracts are then directed to extraction device 35 for further extraction as hereinafter described.

Methanol is now added to the extraction device 19 via a line 37. The light oil raffinate and methanol are thoroughly mixed. The volume ratio of the heavy fraction, light fraction, heavy oil raffinate, or light oil raffinate, to the antisolvent, can be in the range of, for example, 0.5 to 2. In a preferred embodiment of the present invention, the volume ratio of the light oil raffinate to methanol is about 1:1. This parameter is not a limitation upon the present invention. A methanol-rich top layer exits the extraction device 19 via a line 39 which is directed to comingle with another line 45 and then to the extraction device 35 for further treatment. The methanol extract generally contains about 95% methanol and 5% THFA by weight. The light oil-rich bottom layer exits the extraction device 19 through line 47 and enters a heat exchanger 49 where it is heated to approximately 150° F. This oil-rich layer is approximately 99.85% oil and 0.15% THFA. After passing through the heat exchanger 49 the oil is directed to an evaporator 51 via a line 53. Evaporator 51 is, for example, a wiped film evaporator, but any evaporation apparatus will suffice. The jacket of evaporator 51 is heated to approximately 300° F. by steam and a pressure of approximately 50 mm mercury is maintained. As the fluid travels through the evaporator 51 the remaining THFA is vaporized and exits through a vapor line 55 where it is condensed and collected in a storage vessel 57 where it is stored for further use.

The residue or finished light oil exits the evaporator 51 through a residue line 59 and is collected in a storage vessel 61.

The heavy oil raffinate which has entered the extraction device 33 is now mixed with methanol, which enters the extraction device 33 via a line 63. After thorough mixing, the methanol-rich top layer exits the extraction device 33 through the line 45, is comingled with the line 39 as previously described, and is then directed to the extraction device 35 for further treatment. The heavy oil-rich bottom layer exits the extraction device 33 through a line 67. The heavy oil-rich layer then passes through a heat exchanger 69 where it is heated to approximately 140° F. The heavy oil layer is then directed to an evaporator 71 via a line 73. Evaporator 71 is, for example, a wiped film evaporator. The jacket of the evaporator 71 is heated to approximately 300° F. by steam and a pressure of about 50 millimeters mercury is maintained. As the fluid passes through the evaporator 71 the THFA is vaporized and exits through a vapor line 75 where it is condensed and collected in a storage vessel 77. The THFA is then pumped back into the cycle for reuse or to a storage facility through a transfer line 79.

The residue or finished heavy oil product exits the evaporator 71 through a residue line 81 and is collected in a storage vessel 83.

As previously described the light and heavy oil extract lines 21 and 31 are comingled before entering the extraction device 35. Methanol raffinate lines 39 and 45 are similarly comingled before entering the extraction device 35. The components in the extraction device 35 are thoroughly mixed, preferably in a 1:1 volume ratio, and then separated. The top layer which contains the quality oil from the extracts exits through a line 85 and is then directed to comingle with the light oil raffinate line 47 prior to distillation of the THFA from the light oil raffinate. The bottom extract layer exits the extraction device 35 via a line 87 and enters a heat exchanger 89 where it is heated to approximately 150° F. This extract is approximately 45–49% methanol, 45–49% THFA, and 2–10% oil. The extract is next directed to an evaporator 91 via a line 93. Evaporator 91 is, for example, a falling film evaporator. The jacket of the evaporator 91 is heated by steam to approximately 250° F. at approximately 760 millimeters mercury absolute. As the fluid passes through the evaporator 91, the methanol is evaporated overhead. The methanol vapor exits through a distillate line 95, is condensed by an external condenser 97, and is directed to a storage vessel 99 via a line 101. From there the methanol is pumped back into the cycle for reuse or to storage via a line 103. The THFA/oil residue exits the evaporator 91 via a line 105 and is directed through a heat exchanger 107 where it is heated to approximately 180° F. before entering an evaporator 109 via a line 111. The THFA/oil mixture is approximately 90–97% THFA and 3–10% oil. The jacket of evaporator 109 is heated by steam to approximately 200° F. at a pressure of approximately 50 millimeters mercury. As the THFA/oil mixture travels through the evaporator 109, a major portion of the THFA is evaporated overhead. This vapor exits through a distillate line 113, is condensed by an external condenser 115, and is directed to a storage vessel 117. From there the THFA is directed back into the cycle for reuse or to storage via a line 119. The residue in the evaporator 109 exits the evaporator 109 through a residue line 121 and is then directed to an evaporator 123. This residue is approximately 30% THFA and 70% oil. The jacket of the evaporator 123 is heated by steam to approximately 300° F. at a pressure of approximately 50 millimeters mercury. As the residue travels through the evaporator 123 the THFA is evaporated and exits the evaporator 123 through a vapor line 125, is condensed by an external condenser 127, and is directed to comingle with distilled THFA in storage vessel 117. The residue or extract oil exits the evaporator 123 through a residue line 129, is collected in a storage vessel 131 and is then transferred to storage through a transfer line 133.

Figure 3:
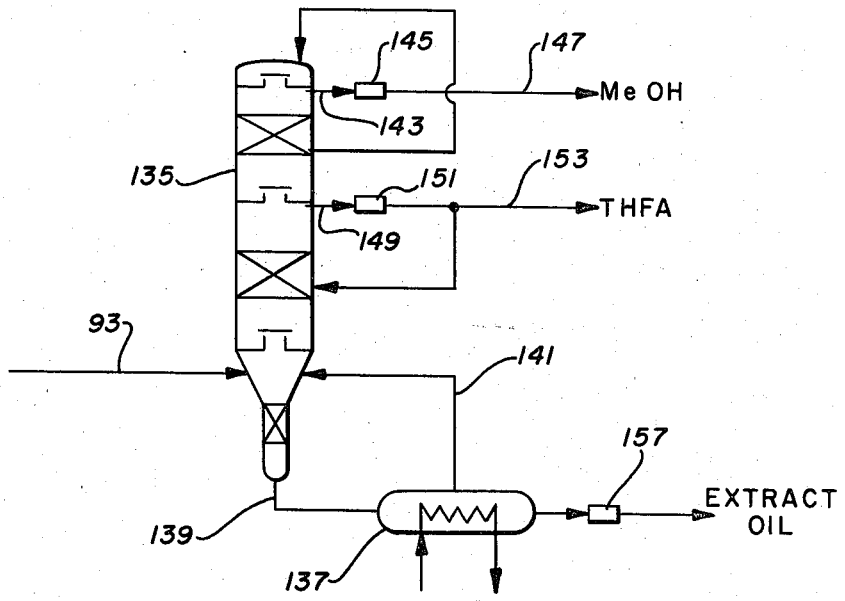
FIG. 3 is a schematic flow sheet illustrating an alternative process for separating a THFA/methanol/oil mixture into discrete components by pump back reflux.

Alternatively, the THFA/Methanol/Oil mixture in line 93 is separated into its discrete component parts by any suitable distillation process. For example as shown in FIG. 3, the line 93 is directed to a distillation column 135 wherein the methanol and THFA are condensed by pump back reflux. Distillation column 135 can be a conventional distillation column including a stream 139 for bottoms with a bottoms heat exchanger 137, a bottoms return line 141, distillate lines 143 and 149, storage vessels 145, 151 and 157 and transfer lines 147 and 153.

EXAMPLE 1

Heavy and light lube oil fractions that were obtained by distillation of a waste lube oil were treated in accordance with the method of the present invention as shown in FIG. 1. The heavy and light lube oil fractions had the following characteristics:

SPECIFICATIONS ON LIGHT AND HEAVY LUBE CUTS

I. BEFORE SOLVENT TREATMENT

| | LT. LUBE | HEAVY LUBE |
|---|---|---|
| Gravity °API | 31.6 | 29.4 |
| Vis. @ 100° F. SSU | 96 | 364 |
| Vis. @ 210° F. SSU | 39 | 55 |
| V.I. | 96 | 92 |
| Flash Point °F. | 360 | 445 |
| Fire Point °F. | 390 | 510 |
| T.A.N. | 2.2 | 2.5 |
| Color Metals ppm | 5.0 | Black |
| Silicon | 2 | 2 |
| Sodium | 1 | 1 |
| Phosphorus | 364 | 84 |

The heavy and light lube fractions were treated in the following manner: Equal portions of Lt. Lube oil and THFA were mixed for 1 minute in a separatory funnel at 130° F. The mixture was allowed to settle for 3 hours. The extract layer was drawn off and distilled under vacuum (2.5 mm) and 200° F. to recover the THFA. The extracted oil left was 14% of the original oil used. The THFA was analyzed on an Infra-Red Spectrophotometer (IRS) and the scan was compared with an IRS scan for fresh THFA. The spectra were essentially the same. The raffinate layer was drawn off and distilled under vacuum (2.5 mm) and 200° F. 5% of the original THFA was recovered. It was also subjected to an IRS and compared with fresh THFA. The spectra were essentially the same. The amount of oil recovered was 86%.

The heavy lube oil was treated the same way and 92% of the oil was recovered.

The finished heavy and light lube oils had the following characteristics:

SPECIFICATIONS ON LIGHT AND HEAVY LUBE CUTS

II. AFTER SOLVENT TREATMENT

| | LT. LUBE | HEAVY LUBE |
|---|---|---|
| Gravity °API | 31.2 | 30.8 |
| Vis. @ 100° F. SSU | 98 | 326 |
| Vis. @ 210° F. SSU | 39 | 54 |
| V.I. | 96 | 100 |
| Flash Point °F. | 380 | 450 |
| Fire Point °F. | 425 | 510 |
| T.A.N. | 0.05 | 0.05 |
| Color Metals ppm | 1.5 | 3.5 |
| Silicon | 2 | 1 |
| Sodium | 1 | 1 |
| Phosphorus | 0 | 0 |

Utilization of the alternate embodiment of the present invention as shown in FIG. 2 yields slightly better characteristics. Specifically, a higher Gravity °API and viscosity index are obtained, and all metals are eliminated from the finished light and heavy lube oils. The color and yield of the finished product are also improved when methanol is utilized.

While this information has been described with respect to preferred embodiments, it is apparent to one skilled in the art that various modifications will now be apparent and such are intended to be within the scope of the appended claims.

We claim:

1. In a process for rerefining used oil containing lubricating oil, where the used oil is rerefined into a heavy lube oil fraction and a light lube oil fraction, the improvement comprising:

(a) mixing the heavy lube oil fraction with an effective amount of tetrahydrofurfuryl alcohol for removing impurities from the heavy lube oil fraction;

(b) separating the heavy lube oil fraction and tetrahydrofurfuryl alcohol mixture into a heavy oil raffinate and a heavy oil tetrahydrofurfuryl alcohol extract;

(c) removing the tetrahydrofurfuryl alcohol from the heavy oil raffinate by mixing the heavy oil raffinate with an effective amount of an antisolvent;

(d) mixing the light lube oil fraction with an effective amount of tetrahydrofurfuryl alcohol for removing impurities from the light lube oil fraction;

(e) separating the light lube oil fraction and tetrahydrofurfuryl alcohol mixture into a light oil raffinate and a light oil tetrahydrofurfuryl alcohol extract; and (f) removing the tetrahydrofurfuryl alcohol from the light oil raffinate by mixing the light oil raffinate with an effective amount of an antisolvent.

2. The process as recited in claim 1 wherein:

(a) the heavy oil raffinate and antisolvent mixture is separated into a heavy oil raffinate and an antisolvent extract;

(b) the light oil raffinate and antisolvent mixture is separated into a light oil raffinate and an antisolvent extract;

(c) the remaining tetrahydrofurfuryl alcohol is removed from the heavy oil raffinate by distilling and steam stripping; and (d) the remaining tetrahydrofurfuryl alcohol is removed from the light oil raffinate by distilling and steam stripping.

3. The process as recited in claim 2 further comprising:

mixing the light oil tetrahydrofurfuryl alcohol extract and the heavy oil tetrahydrofurfuryl alcohol extract with the heavy oil antisolvent extract and the light oil antisolvent extract to remove oil from the tetrahydrofurfuryl alcohol extracts.

4. The process as recited in claim 3 further comprising:

separating the oil from the light and heavy oil tetrahydrofurfuryl alcohol extract/antisolvent extract mixture;

distilling and steam stripping the remaining tetrahydrofurfuryl alcohol from the oil; and separating the antisolvent from the tetrahydrofurfuryl alcohol in the tetrahydrofurfuryl alcohol extract/antisolvent extract mixture.

5. The process as recited in claim 4 wherein the antisolvent is separated from the tetrahydrofurfuryl alcohol in the tetrahydrofurfuryl alcohol extract/antisolvent extract mixture by distilling and steam stripping.

6. The process as recited in claim 1 wherein the antisolvent is methanol, ethanol or acetone.

7. The process as recited in claim 1 wherein the volume ratio of the heavy oil lube fraction to tetrahydrofurfuryl alcohol is between about 0.5 and 2;

the volume ratio of the light lube oil fraction to tetrahydrofurfuryl alcohol is between about 0.5 and 2;

the volume ratio of the heavy oil raffinate to antisolvent is between about 0.5 and 2; and the volume ratio of the light oil raffinate to antisolvent is between about 0.5 and 2.

8. The process as recited in claim 1 wherein each of the heavy and light lube fractions is heated to a temperature of between about 125° F. and 250° F. prior to mixing with tetrahydrofurfuryl alcohol.

9. The process as recited in claim 8 wherein the tetrahydrofurfuryl alcohol is heated to a temperature of between about 125° F. and 250° F. prior to mixing with the lube oil fractions.

10. The process as recited in claim 2 wherein the distilling and steam stripping of the heavy and light oil extracts occur at a reduced pressure.

11. The process as recited in claim 10 wherein the reduced pressure is between about 10 mm Hg and 100 mm Hg absolute.

12. The process as recited in claim 10 wherein the reduced pressure is about 50 mm Hg absolute at a temperature of about 300° F.

13. The process as recited in claim 4 wherein the distilling and steam stripping of the remaining tetrahydrofurfuryl alcohol occur at reduced pressure.

* * * * *

UNITED STATES PATENT AND TRADEMARK OFFICE

CERTIFICATE OF CORRECTION

PATENT NO. : 4,399,025

DATED : August 16, 1983

INVENTOR(S) : Laird C. Fletcher et al.

It is certified that error appears in the above-identified patent and that said Letters Patent is hereby corrected as shown below:

In the Abstract, line 14, delete "tetrahydrofurfuyl" and insert --tetrahydrofurfuryl--.

Column 2, line 10, delete "tube" and insert --lube--.

Column 4, line 65, delete "mg Hg" and insert --mm Hg--.

Signed and Sealed this

*Seventeenth* Day of *April 1984*

[SEAL]

*Attest:*

GERALD J. MOSSINGHOFF

*Attesting Officer*

*Commissioner of Patents and Trademarks*